United States Patent [19]

Felicetta

[11] Patent Number: 4,519,216

[45] Date of Patent: May 28, 1985

[54] SELF CONTAINED INDIRECT REFRIGERATION SYSTEM

[76] Inventor: Joseph A. Felicetta, 25 Eastlyn Dr., Bardonia, N.Y. 10954

[21] Appl. No.: 438,368

[22] Filed: Dec. 23, 1982

[51] Int. Cl.[3] ..... F25D 17/02

[52] U.S. Cl. ..... 62/185; 62/201; 62/435

[58] Field of Search ..... 62/185, 201, 435, 436; 165/104.19

[56] References Cited

U.S. PATENT DOCUMENTS

| | | | |
|---|---|---|---|
| 2,460,623 | 2/1949 | Zoppola | 62/435 |
| 3,301,318 | 1/1967 | Haake | 62/345 X |
| 3,493,037 | 2/1970 | Haake | 62/345 X |
| 4,280,335 | 7/1981 | Perez et al. | 62/435 X |
| 4,415,847 | 11/1983 | Galloway | 62/185 |

*Primary Examiner*—William E. Wayner

[57] ABSTRACT

An S.I.R SYSTEM is a self-contained, indirect, refrigeration system which effectively and efficiently removes varying heat loads (i.e. heat of respiration of climacteric fruits) at changeable operating conditions. System design allows for quick and easy installation. The system comprises a refrigeration means for cooling a coolant passing therethrough, a coolant storage means for the coolant, the storage means comprising a primary and secondary coolant storage means, means for selectively conveying cooling from the primary coolant storage means to the refrigeration means for cooling, means for conveying the cooled coolant from the refrigeration means to the secondary coolant storage means, means for conveying coolant from the secondary coolant storage means to the primary coolant means when the secondary coolant storage means contains a predetermined volume of coolant, means for selectively conveying coolant from the primary coolant storage means to the cooling means for the storage area, and means for conveying the coolant from the cooling means after it has cooled the storage area and conveying it to the secondary coolant storage means.

7 Claims, 1 Drawing Figure

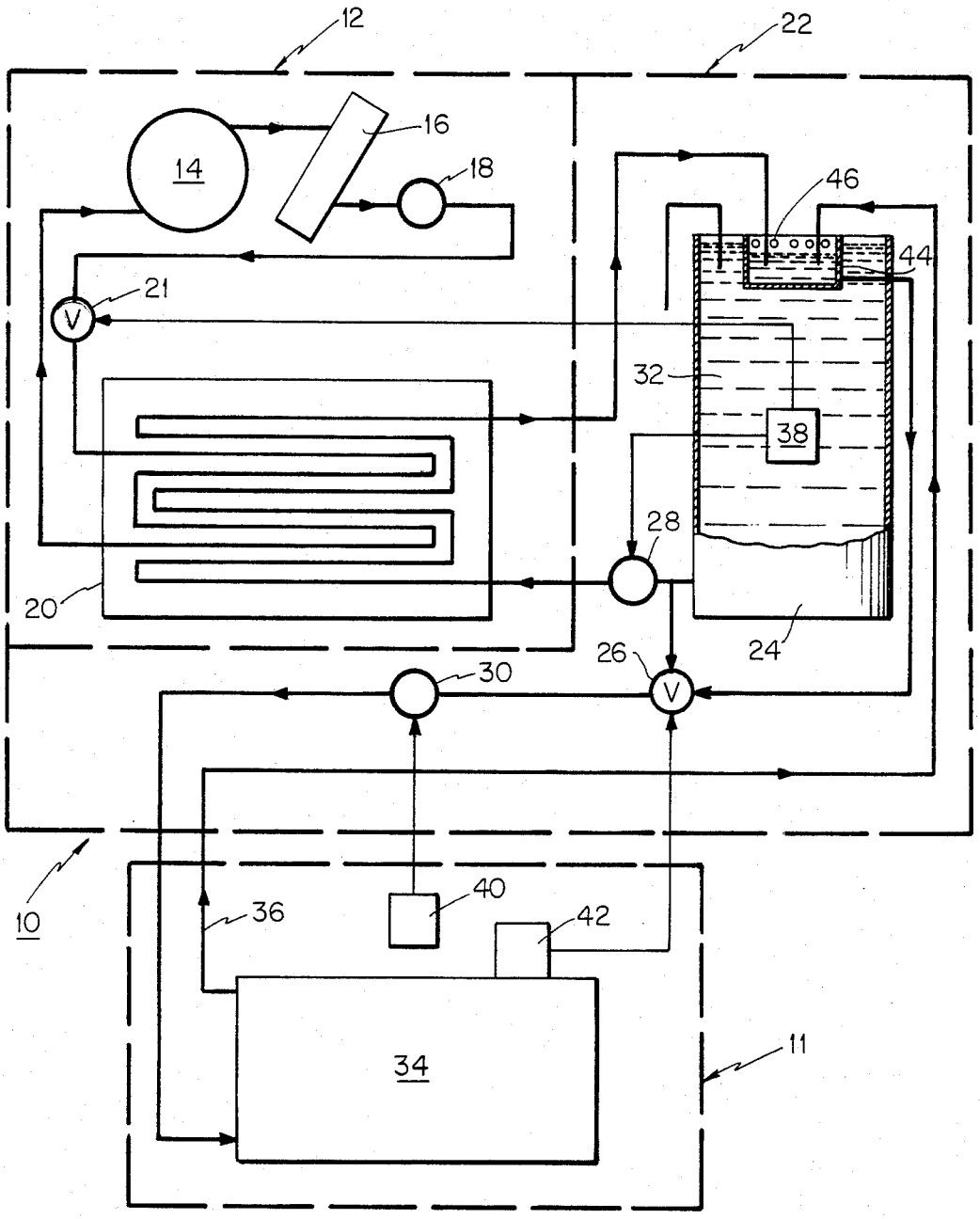
12
22
16
14
18
46
44
21
V
32
38
28
20
24
26
30
V
10
36
40
42
34
11

SELF CONTAINED INDIRECT REFRIGERATION SYSTEM

BACKGROUND

Conventional refrigeration systems have two basic units—a condensing unit (compressor, condenser, receiver, control and safety devices) and an air handling unit (cooling coil, heaters, fan motor). The system must be designed to operate at a wide range of ambient temperatures, various operating temperatures/pressures and various cooling/humidity conditions. Since all system components are primarily controlled by refrigerant gas pressures, achieving effective and efficient operation under the above conditions is usually difficult or impossible. Conventional refrigeration system design which includes compressor unloading, hot gas by-pass, complex control circuits, etc. are usually ineffective, inefficient and difficult to install and maintain.

OBJECTS AND SUMMARY OF THE INVENTION

It is an object of this invention to provide an S.I.R. system which can effectively and efficiently remove varying heat loads at changeable operating conditions.

It is a further object of this invention to provide for a refrigeration system whose design allows for quick and easy installation.

It is still a further object of this invention to provide for a refrigeration system whose components, e.g. compressor, condenser, chiller, receptacles, etc., can be sized to accommodate project loads for various ripening/storage room requirements.

It is still a further object of this invention to provide for a refrigeration system which can be manufactured and tested at the factory and then shipped ready to operate at temperatures that are adjustable in the field.

A refrigeration system is provided for cooling a storage area through a cooling means in said storage area. The system comprises:

(a) a refrigeration means for cooling a coolant passing therethrough;

(b) a coolant storage means for the coolant, the storage means comprising a primary and secondary coolant storage means;

(c) means for selectively conveying coolant from the primary coolant storage means to the refrigeration means for cooling;

(d) means for conveying the cooled coolant from the refrigeration means to the secondary coolant storage means;

(e) means for conveying coolant from the secondary coolant storage means to the primary coolant storage means when the secondary coolant storage means contains a predetermined volume of coolant;

(f) means for selectively conveying coolant from the primary coolant storage means to the cooling means for the storage area; and (g) means for conveying the coolant from the cooling means after it has cooled the storage area and conveying it to the secondary coolant storage means.

BRIEF DESCRIPTION OF THE DRAWING

The one and only FIGURE herein is a schematic flow diagram of a preferred embodiment of the indirect refrigeration system of this invention.

DETAILED DESCRIPTION OF THE INVENTION

Referring to the FIGURE herein, an S.I.R. SYSTEM 10 is provided for removing varying heat loads (e.g. heat of respiration of climacteric fruits) from, for example a ripening/storage area 11. The system comprises a basic closed-loop refrigeration circuit 12 having a compressor 14, condenser 16, receiver 18, chiller 20, controls and safety devices (safety valve 21, other not shown). The system further comprises a closed-loop glycol mixture circuit 22 having specially designed insulated storage tank 24, mixing valve 26, circulators 28, 30, controls (38) and safety devices.

The closed-loop refrigeration circuit 10 chills the glycol mixture 32 in the storage tank 24 from the temperature at the cooling coil, exit 36 to the desired temperature of the glycol mixture 32 in the storage tank 24. Both temperatures can be field set by adjusting the differential thermostat 38, which senses the temperature of the glycol mixture 32 in the storage tank 24.

When the desired temperature of the glycol mixture 32 in storage tank 24 is reached, the closed-loop refrigeration circuit 12 stops operating and the glycol mixture 32 can be circulated to the cooling coil 34.

An adjustable close differential thermostat, 40 maintains the required ripening/storage temperature in the ripening/storage area 11 by controlling the operation of the circulator 30, $C_2$ in the closed-loop glycol mixture circuit 22. Another adjustable close differential thermostat $T_2$, 42 maintains the temperature of the cooling coil 34 by controlling a mixing valve 26, which allow some of the glycol mixture 32 exiting the cooling coil at 36 to be recycled with the glycol mixture 32 in the storage tank 24.

The specially designed insulated storage tank 24 has an internal vessel 44 that can store a small amount of the glycol mixture 32 exiting the cooling coil at 36 during the operation of the closed-loop glycol mixture circuit 22. An oversupply of glycol mixture 32 can exit the vessel 44 through overflow holes 46 and mix with glycol mixture 32 in the storage tank 24. During the operation of the closed-loop refrigeration circuit 12, the internal vessel 44 filters and evenly distributes through hole 46 the glycol mixture 32 existing the chiller 20 which then enters the storage tank 24.

Still referring to the FIGURE, in operation thermostat 38, maintains the temperature of glycol mixture 32 in storage tank 24 by controlling solenoid valve 21 in the closed-loop refrigeration circuit 12 and circulator 28, in the closed-loop glycol mixture circuit 22. Glycol mixture 32 is circulated through the chiller 20 and enters storage tank 24 through internal vessel 44 and overflow holes 46. The ripening 20 storage temperature of ripening/storage area 11 is maintained by thermostat 40, which controls circulator in the closed-loop glycol mixture circuit 22. Thermostat 42, controls mixing valve 26, to maintain the required cooling coil 34 exit temperature at the exit 36. Both circulators, 28 and 30 are electrically interlocked. Circulator, 30 operates only when circulator 28, is not operating. Thermostat 42, operates mixing valve 26 only when circulator 30, is operating.

Thus, S.I.R. SYSTEM of this invention can effectively and efficiently remove varying heat loads (i.e. heat of respiration of climacteric fruits) by a specially designed closed-loop glycol mixture circuit 22 with adjustable thermostats 38, 40, 42 to control ripening/s-torage temperatures, glycol mixture supply temperatures and glycol mixture storage temperatures. The closed-loop refrigeration circuit 12 removes the heat absorbed by the glycol mixture in the closed-loop glycol mixture circuit 22 by operating to lower the temperature of the mixture to the storage tank 24, with little or no variation in operating condition, with no short cycling and with no excessive heat loads.

The system can be manufactured and tested at the factory, then shipped ready to operate. Installation would only require making the glycol mixture line connections, making the electrical power connections, and adding water to fill the closed-loop glycol mixture circuit. Basic components (compressor 14, condenser 16, chiller 20, cooling coil 36, storage tank 24, etc.) of the system can be sized to accommodate product loads for various ripening/storage room requirements.

The system can be manufactured and tested at the factory, then shipped with supply of glycol in the storage tank 24 (approximately 50% of the storage tank capacity). Installation would only require making the inlet and outlet glycol mixture line connections, making the electrical power connections and adding water to fill the closed-loop glycol mixture circuit.

I claim:

1. A refrigeration system for cooling a storage area through a cooling means in the storage area, comprising:

(a) a refrigeration means for cooling a coolant passing therethrough to a predetermined temperature;

(b) a coolant storage means for the coolant, the storage means comprising a primary and secondary coolant storage means;

(c) means for selectively conveying coolant from the primary coolant storage means directly to the refrigeration means for cooling the coolant to the predetermined temperature;

(d) means for returning the coolant from the refrigeration means directly to the primary coolant storage means;

(e) means for selectively conveying coolant from the primary coolant storage means to the cooling means for the storage area;

(f) means for conveying the coolant from the cooling means, after it has cooled the storage area and had its temperature raised to a temperature greater than the predetermined temperature, to the secondary coolant storage means; and (g) means for selectively conveying coolant from the secondary coolant storage means and selectively mixing said coolant with the coolant being conveyed from the primary coolant storage means to the cooling means for the storage area.

2. The refrigeration system of claim 1, further comprising means for conveying the coolant from the secondary coolant storage means to the primary coolant storage means when said secondary coolant storage means contains a predetermined volume of coolant.

3. The refrigeration system of claim 1, wherein the storage area is a storage area for climacteric fruits, said storage area being cooled to remove the heat of respiration of said fruits.

4. The system of claim 1, wherein elements (a) through (g) are in a self-contained unit to be coupled to the cooling means.

5. The system of claim 1, wherein the coolant is a glycol mixture.

6. The system of claim 1, wherein the primary and secondary coolant storage means are vessels, and the secondary coolant storage means is adapted to overflow into the primary coolant storage means.

7. The system of claim 6, wherein the secondary coolant storage means includes overflow holes in the top of the secondary coolant storage means vessel through which the coolant overvlows into the primary coolant storage means vessel.

* * * * *